US006797014B1

(12) United States Patent
Schöfberger et al.

(10) Patent No.: US 6,797,014 B1
(45) Date of Patent: Sep. 28, 2004

(54) LIGHFASTNESS-IMPROVEMENT OF DYEINGS ON ALUMINUM OXIDE LAYERS

(75) Inventors: Georg Schöfberger, Basel (CH); Günther Tscheulin, Frick (CH)

(73) Assignee: Clariant Finance Limited, Tortola (VG)

( * ) Notice: Subject to any disclaimer, the term of this patent is extended or adjusted under 35 U.S.C. 154(b) by 26 days.

(21) Appl. No.: 10/088,434

(22) PCT Filed: Sep. 22, 2000

(86) PCT No.: PCT/IB00/01345

§ 371 (c)(1),
(2), (4) Date: Mar. 15, 2002

(87) PCT Pub. No.: WO01/21860

PCT Pub. Date: Mar. 29, 2001

(30) Foreign Application Priority Data

Sep. 23, 1999 (EP) ..... 99810855

(51) Int. Cl.[7] ..... C25D 11/24
(52) U.S. Cl. ..... 8/522; 8/623; 8/685; 8/686
(58) Field of Search ..... 8/522, 506, 623, 8/685, 686

(56) References Cited

U.S. PATENT DOCUMENTS

| | | | |
|---|---|---|---|
| 3,917,887 | A | 11/1975 | Stiller |
| 4,648,911 | A | 3/1987 | Gruninger |
| 6,210,448 | B1 | 4/2001 | Korte |
| 6,309,427 | B1 | 10/2001 | Korte |

FOREIGN PATENT DOCUMENTS

| | | | |
|---|---|---|---|
| DE | 36 41 766 | | 6/1988 |
| GB | 703949 | * | 2/1954 |
| GB | 1 022 751 | | 3/1966 |
| WO | 84/00982 | | 3/1984 |
| WO | 98/54264 | | 12/1998 |
| WO | 98/58025 | | 12/1998 |

OTHER PUBLICATIONS

English abstract for DE 3641766, Jun. 9, 1988.
Ullmann's "Enzyklopadie der Technischen Chemie" [Encylopedia of Industrial Chemistry], 4th Edition, vol. 12, pp. 196–198, no date available.
Sandoz brochure "Sanodol®" (Sandoz AG, Basel, Switzerland, Publication No. 9083.00.89, no date available.
Guide to the adsorptive dyeing of anodized aluminium, Sandoz Publication No. 9122.00.80, no date available.

* cited by examiner

*Primary Examiner*—Margaret Einsmann
(74) *Attorney, Agent, or Firm*—Scott E. Hanf; Anthony A. Bisulca

(57) ABSTRACT

Process for the production of dyed oxide layers on aluminum or aluminum alloys by dyeing in an aqueous dyebath, rinsing with water and sealing, in which the dyeing is carried out using at least one water-soluble anionic dye (A) which possesses at least one substituent and/or component combination with a ligand character that is capable of forming a nickel complex with nickel ions, and the sealing is carried out by cold sealing with at least one sealing agent preparation (B) containing nickel ions $Ni^{2+}$ and fluoride ions $F^-$ and optionally hot secondary sealing with water, especially for achieving dyeings of improved light fastness.

13 Claims, No Drawings

LIGHFASTNESS-IMPROVEMENT OF DYEINGS ON ALUMINUM OXIDE LAYERS

Structures, articles or parts made of aluminium or aluminium alloys which are provided with a protective oxide layer, in particular an oxide layer produced electrochemically by anodization, are nowadays increasingly being used in engineering and construction, for example as a component and/or for the decoration of buildings or means of transport or for utility or artistic articles. For the aesthetic design of such structures, articles or parts, they, or their oxide layers, are frequently coloured. It is therefore desirable for the coloured layers to retain their coloured design for as long as possible and consequently to have very high levels of fastness to environmentally caused influences, especially to the action of sunlight.

Usually this problem is approached by employing dyestuffs of selected structures, which provide dyeings of very high light fastnesses on anodized aluminium, such as described e.g. in EP-A-986615 or 988343.

The surface of the anodized aluminium may be sealed in various ways, e.g. with boiling water or also with particular sealants or sealing salts. In WO-A-84 00982 there is described a process for sealing the anodized, uncoloured or coloured surface in a still wet state at a temperature <30° C. with a solution containing a nickel salt and a fluoride in order to improve the touch-resistance and corrosion-resistance of the surface.

In DE-A-3641766 there is described a two-stage process for the sealing of anodized and dyed aluminium by treatment first with an aqueous $Ni^{2+}$ and $F^-$ ions containing solution and then with hot water or steam in order to improve the weather and light fastnesses of dyeings, the mentioned dyeing being a dyeing with a dyeing electrolyte that contains a metal salt and an organic dye component.

For the colouring of oxide layers on aluminium or aluminium alloys, dyes of various shades are known, and the oxide layers dyed therewith can be sealed in a manner which is conventional per se, for example with hot water. However, the dyeings obtainable in each case can have greatly different light fastnesses, especially after extended exposure to the sun, so that—particularly in the case of multicoloured articles—the dyeing which is the least light-fast impairs the overall impression of the coloured article. It is thus desired to achieve dyeings with better light fastness properties and also to bring the light fastness of different dyeings to a level which is higher overall, i.e., for example, to bring dyeings with dyes which produce light fastnesses which are weaker per se to the light fastness level of dyeings obtainable with dyes which produce light fastnesses which are very high per se. By sealing with certain sealing agents, for example based on nickel at the boiling temperature, a certain improvement in the light fastness can be achieved in some cases, but this is still insufficient in many cases, particularly for articles intended for external architecture, i.e. which are exposed to sunlight for a very long time.

It has now been found that the light fastness of adsorptive dyeings obtainable on aluminium oxide layers with certain dyestuffs (A) which, due to their too low light fastness, are usually considered as being unsuitable or not well suitable for the dyeing of aluminium oxide layers for the production of dyed external construction elements which will be subject to very long sunlight exposure, can be improved to a surprisingly high level by a cold sealing with a sealant (B) containing $Ni^{2+}$ and $F^-$ ions, as described in more detail below.

The invention relates to the process for the production of the dyed oxide layers, to the corresponding light fastness improvement agents, and to the substrates dyed in this way.

A first subject-matter of the invention is thus a process for the production of dyed oxide layers on aluminium or aluminium alloys by dyeing in an aqueous dyebath, rinsing with water and sealing, which is characterized in that the dyeing is carried out using at least one water-soluble anionic dye (A) which possesses at least one substituent and/or component combination with a ligand character that is capable per se of forming a nickel complex with nickel ions, and the sealing is carried out by cold sealing with at least one sealing agent (B) containing nickel ions $Ni^{2+}$ and fluoride ions $F^-$.

The dyes (A) which can be employed in accordance with the invention generally belong to the series of those which are known for the dyeing of aluminium oxide layers or can be used for this purpose. They are anionic and preferably possess at least one sulpho group in the molecule. They are capable of forming complexes with nickel(II) ions, in particular labile nickel complexes. Correspondingly, the dyes (A) advantageously contain suitable available electron pairs in suitable orbital configurations and/or heteroatoms, in particular as occur in substituent and/or component combinations with a ligand character. In other words, substituent and/or component combinations with a ligand character which are capable of forming labile Ni complexes with nickel ions are present in (A). Such configurations are produced, for example, through combination of corresponding metallizable substituents which are able to bind the nickel ion in a labile manner, such as, for example, a hydroxyl group and a carboxyl group vicinal thereto, as are present in salicylic acid, or, in 1:1 metal complexes, especially copper complexes, heteroatomic moieties, in particular nitrogen atoms as ring members of a heterocyclic ring, only some or none of which participate in the copper complex formation, as present, for example, in copper phthalocyanine complexes (particularly copper complexes), and/or in copper complexes of monoazo dyes which contain a coupling component from the oxyquinoline or pyrazolone series as azo component. The salicylic acid groups are in particular those which are bonded to the remaining part of the dye molecule in the meta-position and/or para-position to the carboxyl group, preferably via at least one heteroatomic bridging unit. The following may be mentioned as examples of suitable dyes (A): sulpho group-containing phthalocyanine-copper complexes, salicylic acid group-containing, sulpho group-containing mono- and disazo dyes, salicylic acid group-containing, sulpho group-containing metal complexes of monoazo dyes complexed to the azo group (for example 1:1 Cu, 1:1 or 1:2 Cr, 1:2 Co complexes), and sulpho group-containing 1:1 metal complexes, particularly copper complexes, of monoazo dyes containing a coupling component from the oxyquinoline or pyrazolone series as azo component.

Representative examples are the dyes of the general formulae (I)

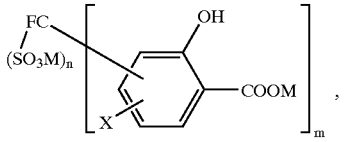

in which X denotes hydrogen or a bond to FC, m denotes 1 or 2, n denotes a number from 1 to twice the total number of aromatic rings in the molecule, M denotes hydrogen or a non-chromophoric cation and FC denotes the (m+n)-valent residual chromophoric part of the dye, (II)

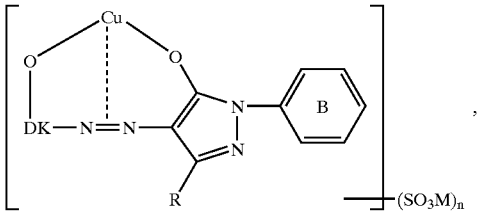

in which R denotes $C_{1-4}$-alkyl,

M denotes hydrogen or a non-chromophoric cation, n denotes a number from 1 to twice the total number of aromatic rings in the molecule, and DK denotes the radical of a diazo component, and the ring B may optionally be further substituted, for example with $C_{1-4}$-alkyl, and (III)

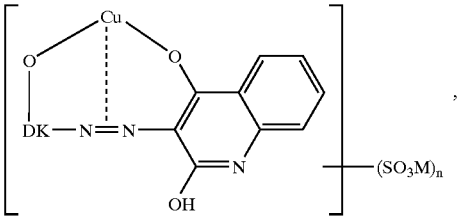

in which M denotes hydrogen or a non-chromophoric cation, n denotes a number from 1 to twice the total number of aromatic rings in the molecule and DK denotes the radical of a diazo component.

Other sulpho group-containing dyes (A) from the 1:1 copper complex series may also be employed in the process according to the invention. By contrast, less suitable or unsuitable dyes are those which contain conjugated carbonyl groups and contain no salicylic acid groups (for example anthraquinone dyes), or 1:2 metal complexes which contain no salicylic acid groups. Suitable as (A) are particularly those dyes which, dyed on anodized aluminium and sealed with boiling water, give dyeings which have a light fastness of <7, determined in accordance with ISO specification No. 105 B02 (USA) (by dry exposure with a standard illuminant in an Atlas Ci 35 A Weather-O-meter), particularly those whose dyeings, sealed with boiling water, have a light fastness, determined in this way, of ≦6. Dyes which come into consideration in particular are those whose dyeings on anodized aluminium, sealed hot, in particular at temperatures of >80° C., with a nickel compound, have a light fastness, in accordance with ISO specification No. 105 B02 (USA), of ≦7 or even ≦8.

The anionic dyes (A) can be in the form of the free acids or preferably in the form of water-soluble salts, for example as alkali metal, alkaline earth metal and/or ammonium salts, particularly as described below for M.

M can stand for hydrogen or a non-chromophoric cation. If a plurality of anionic groups are present in the molecule, the respective M can have identical or different meanings. Hydrogen as ion is in the form of the hydronium ion. As non-chromophoric cations, alkali metal cations, ammonium cations and alkaline earth metal cations, for example, come into consideration. As alkaline earth metal cations, calcium and magnesium, for example, may be mentioned. As ammonium cations, unsubstituted ammonium or alternatively ammonium ions of low-molecular-weight amines may be mentioned, principally mono-, di- or tri-$C_{1-2}$-alkyl- and/or -β-hydroxy-$C_{2-3}$-alkyl-ammonium, for example mono-, di- or tri-isopropanolammonium, mono-, di- or tri-ethanolammonium, N-methyl-N-ethanolammonium. As alkali metal cations, conventional cations of this type come into consideration, for example lithium, sodium and/or potassium ions. Of the said cations, the alkali metal cations and ammonium cations are preferred. According to one embodiment of the invention, some of the symbols M stand for hydrogen and the remainder thereof stand for alkali metal and/or ammonium cations.

The oxide layers to be dyed are, in particular, synthetically produced oxide layers on aluminium or aluminium alloys.

Aluminium alloys which principally come into consideration are those in which the aluminium content preponderates, especially alloys with magnesium, silicon, zinc and/or copper, for example Al/Mg, Al/Si, Al/Mg/Si, Al/Zn/Mg, Al/Cu/Mg and Al/Zn/Mg/Cu, preferably those in which the aluminium content makes up at least 90 percent by weight; the magnesium content is preferably ≦6 percent by weight; the silicon content is preferably ≦6 percent by weight; the zinc content is preferably ≦10 percent by weight; the copper content is advantageously ≦2 percent by weight, preferably ≦0.2 percent by weight.

The oxide layers formed on the metallic aluminium or on the aluminium alloys may have been generated by chemical oxidation or preferably by galvanic means by anodic oxidation. The anodic oxidation of the aluminium or of the aluminium alloy for passivation and formation of a porous layer can take place by known methods, using direct current and/or alternating current, and using electrolyte baths which are suitable in each case, for example with addition of sulfuric acid, oxalic acid, chromic acid, citric acid or combinations of oxalic acid and chromic acid or sulfuric acid and oxalic acid. Such anodization methods are known in industry, for example the DS method (direct current; sulfuric acid), the DSX method (direct current; sulfuric acid with addition of oxalic acid), the DX method (direct current; oxalic acid), the DX method with addition of chromic acid, the AX method (alternating current; oxalic acid), the AX-DX method (oxalic acid; first alternating current then direct current), the AS method (alternating current; sulfuric acid) and the chromic acid method (direct current; chromic acid). The current voltages are, for example, in the range from 5 to 80 volts, preferably from 8 to 50 volts; the temperature are for example, in the range from 5 to 50° C.; the current density at the anode is, for example, in the range from 0.3 to 5 A/dm$^2$, preferably from 0.5 to 4 A/dm$^2$, where current densities, as low as ≦2 A/dm$^2$ are generally suitable for generating a porous oxide layer, at higher voltages and current densities, for example in the range from 100 to 150 volts and ≦2 A/dm$^2$, particularly from 2 to 3 A/dm$^2$, and at temperatures up to 80° C., particularly hard and fine-pored oxide layers can be generated, for example by the "Ematal" method with oxalic acid in the presence of titanium salts and zirconium salts. In the production of oxide layers which are subsequently dyed electrolytically or directly by adsorptive methods with a dye of the formula (1), the voltage is, according to a preferred procedure which is conventional per se in practice, in the range from 12 to 20 volts; the current density here is preferably from 1 to 2 A/dm$^2$. These anodization methods are known in general terms in industry and are also described in detail in the specialist literature, for example in Ullmann's "Enzyklopädie der Technischen Chemie" [Encyclopedia of Industrial Chemistry], $4^{th}$ Edition, Volume 12, pages 196 to 198, or in the Sandoz brochures "Sanodal®" (Sandoz AG, Baste, Switzerland, Publication No. 9083.00.89) or "Ratgeber für das Adsorptive Färben von Anodisiertem Aluminium" [Advice for the Adsorptive Dyeing of Anodized Aluminium] (Sandoz, Publication No. 9122.00.80). The layer thickness of the porous oxide layer is advantageously in the range from 5 to 35 μm, preferably from 20 to 30 μm, particularly from 20 to 25 μm. In the case of colour anodization, the thickness of the oxide layer is, for example, values in the range from 5 to 60 μm, preferably from 10 to 40 μm. If the anodized aluminium or the anodized aluminium alloy has been stored for a short time (for example 1 week or less) before the dyeing, it is advantageous to wet and/or to activate the substrate before the dyeing, for example by treatment with a non-reducing, aqueous mineral acid, for example with sulfuric acid or nitric acid. If desired, the oxide layer—analogously to the known "Sandalor®" method can first be pre-dyed electrolytically, for example in a bronze shade, and subsequently over-dyed with a dye of the formula (A); in this way, particularly opaque shades are obtainable which are particularly suitable for use, for example, in external architecture. It is also possible for oxide layers pre-dyed by colour anodization (by the method known as integral dyeing) to be over-dyed with a dye (A); in this way, opaque shades which are particularly suitable, for example, for external architecture are likewise obtainable.

For the dyeing of the oxide layer with the anionic dyes (A), use can be made of dyeing methods which are conventional per se, in particular adsorption methods (essentially without voltage), where the dye solution can be applied, for example, to the oxide surface, for example by spraying-on or by application with a roll (depending on the shape of the substrate), or preferably by immersing the object to be dyed into a dye bath. In accordance with one embodiment of the dyeing process according to the invention, the anodized metal objects can be treated with the dye bath after the anodic treatment and the rinsing in the same vessel in which the anodization has taken place, or, in accordance with a further embodiment, the objects to be dyed can be removed from the vessel after the anodic treatment and the rinsing and dyed in a second unit either directly or after drying and possibly intermediate storage, where, if the objects have been stored in the intermediate, it is advisable to carry out an activation (for example by brief treatment with sulfuric acid or nitric acid) before the dyeing. It is noted in this respect that an intermediate storage—if it takes place at all—preferably takes place for a restricted, short time, for example less than 1 week, particularly ≦2 days. In accordance with preferred, generally conventional processes, dyeing is carried out immediately after anodization and subsequent rinsing.

The dyeing expediently takes place at temperatures below the boiling point of the liquor, advantageously at temperatures in the range from 15 to 80° C., preferably in the range from 15 to 70° C., particularly preferably from 20 to 60° C. The pH of the dyeing liquor is, for example, in the clearly acidic to weakly basic range, for example in the pH range from 3 to 8, where weakly acidic to nearly neutral conditions are preferred, in particular in the pH range from 4 to 6. The dye concentration and the dyeing duration can vary very greatly depending on the substrate and the desired dyeing effect. For example, suitable dye concentrations are in the range from 0.01 to 20 g/l, advantageously from 0.1 to 10 g/l, in particular from 0.2 to 2 g/l. The dyeing duration can be in the range from 30 seconds to 1 hour, advantageously from 1 to 60 minutes, preferably from 5 to 40 minutes.

The dyeings obtained in this way can now be sealed. Prior to sealing, the dyeings are rinsed with water.

The sealing agents (B) to be employed in accordance with the invention advantageously contain the nickel ions and the fluoride ions in the form of nickel fluoride. If desired, the nickel fluoride can be produced by reaction of nickel acetate and an alkali metal fluoride (advantageously sodium fluoride), or (B) can consist of nickel fluoride or a mixture of nickel acetate and sodium fluoride or, in accordance with a preferred variant, (B) consists of nickel fluoride mixed with nickel acetate and sodium fluoride, where nickel fluoride advantageously makes up at least 50% by weight of the mixture, preferably at least 70% by weight, for example from 70 to 95% by weight, particularly preferably at least 80% by weight; in the mixture of the $Ni^{2+}$ and $Na^{+}$ ions, the proportion of $Ni^{2+}$ ions is advantageously at least 50 mol-%, preferably at least 70 mol-1%, the proportion of $Na^{+}$ ions being for example from 3 to 15 mol-%; in the mixture of the acetate ions and fluoride ions, the proportion of fluoride ions is advantageously at least 50 mol-%, preferably at least 70 mol-%, the proportion of acetate ions being for example from 3 to 15 mol-%. If desired, and depending on the substrate and/or dyeing, sealing auxiliaries for example cobalt compounds, may be present in (B) in small proportions, for example up to 10% by weight of (B), for example from 0.1 to 5% by weight of (B). The sealing agents (B) are advantageously employed in the form of (B)-containing preparations ($B_P$), which may be, for example, aqueous solutions of (B) or mixtures of (B) with further auxiliaries, in particular with anionic surfactants (T), or also aqueous solutions of such mixtures. Suitable anionic surfactants (T) are known substances, in particular sulpho group-containing surfactants, preferably products of the condensation of sulpho group-containing aromatics with formaldehyde, for example products of the condensation of sulphonated naphthalene or/and sulphonated phenols (which may optionally be further substituted, for example by methyl) with formaldehyde to give oligomeric condensation products with a surfactant character. The weight ratio of (T) to (B) is advantageously in the range from 0.1 to 20% by weight, preferably from 0.2 to 15% by weight. If aqueous solutions of (B) or of mixtures of (B) and (T) are employed as ($B_P$), the (B) content is advantageously in the range from 2 to 40% by weight, preferably from 4 to 25% by weight, of the aqueous concentration preparation. If (B) or ($B_P$) is used as a dry product (for example with a water content of ≦10% by weight), it is advantageous, for simpler metering and addition or metered addition, to formulate this with water to give an aqueous concentrated preparation of the concentrations indicated above.

The cold sealing with (B) or ($B_P$) can be carried out, for example, at temperatures below 40° C., for example in the range from 18 to 35° C., preferably from 20 to 30° C. The $Ni^{2+}$ concentration in the sealing bath is advantageously in the range from 0.05 to 10 g/l, preferably in the range from 0.1 to 5 g/l, with concentrations below 2 g/l, in particular in the range of 0.4 to 1.9 g/l, there being already obtainable outstanding results. The $F^{-}$ concentration by weight in the sealing bath is preferably inferior to the $Ni^{2+}$ concentration, e.g. as corresponds to the ratio in the nickel fluoride ±20%, or even ±10%. The $F^{-}$ concentration in the sealing bath is advantageously in the range from 0.03 to 7 g/l, preferably in the range from 0.06 to 3.5 g/l, with $F^{-}$ concentrations below 1.5 g/l, e.g in the range of 0.2 to 1.3 g/l, or even below 1 g/l there being already obtainable outstanding results. The pH of the sealing bath is, for example, in the acidic to weakly basic range, advantageously in the pH range from 4.5 to 8.

The duration of the sealing can advantageously depend on the layer thickness and is, for example, from 0.4 to 2 minutes, preferably from 0.6 to 1.2 minutes, per $\mu$m thickness of the oxide layer of the substrate, sealing advantageously being carried out for from 5 to 60 minutes, preferably for from 10 to 30 minutes For the preferred oxide layers with a thickness of at least 20 $\mu$m, preferably from 20 to 30 $\mu$m, mostly from 20 to 25 $\mu$m, which are particularly suitable for external architectural components, sealing durations of from 10 to 30 minutes, for example 20 minutes, are, for example, already suitable.

The cold sealing with (B) is advantageously followed by hot sealing with water. This means that it is advantageous to carry out a two-step sealing, in which cold sealing is carried out in the first step with at least one sealing agent (B) as described, and in the second step hot sealing is carried out with water. The second step of the two-step sealing, i.e. the hot treatment with water, is advantageously carried out in the temperature range from 80° C. to the boiling point, preferably from 90 to 100° C., or alternatively steam at temperatures of from 95 to 150° C., optionally under pressure, for example at an excess pressure in the range from 1 to 4 bar. The duration of the secondary sealing with water is, for example, in the range from 15 to 60 minutes.

Surprisingly, the process according to the invention enables high light fastnesses of the dyeings to be achieved, and it is in particular possible, even for external architectural purposes, to employ dyes which would otherwise not be suitable for this purpose owing to their inadequate light fastness. Thus, the process according to the invention is, in particular, one in which dyes can be employed with which dyeings are obtainable whose light fastnesses, if they are hot sealed only with water, are lower than those of the dyeings sealed in accordance with the invention, it also being possible to employ particularly dyes whose dyeings, if hot sealed only with water, are 2 or even more light fastness grades lower.

The light fastness can be determined in accordance with ISO specifications, for example in accordance with ISO specification No. 2135-1984 by dry exposure of a sample in exposure cycles of 200 hours each with a standard illuminant in an Atlas 65 WRC Weather-O-meter fitted with a xenon arc lamp, or in accordance with ISO specification No. 105 B02 (USA) by dry exposure of a sample in exposure cycles of 100 hours each with a standard illuminant in an Atlas Ci 35 A Weather-O-meter fitted with a xenon arc lamp, and comparing the exposed samples with a grade pattern, for example with the light fastness grade=6 on the blue scale (corresponding approximately to grade 3 on the grey scale), or directly with the blue master with grade 6. If the light fastness value corresponding to grade 6 in accordance with the blue is only achieved after two exposure cycles, the pattern is assessed as having a light fastness grade=7; if this is only achieved after 4 cycles, the pattern is ascribed a fastness grade of 8, and so on, as shown in the Table below.

TABLE

| | Exposure time | | |
|---|---|---|---|
| Exposure cycle | 65 WRC | Ci 35 A | Light fastness grade |
| 1 | 200 hours | 100 hours | 6 |
| 2 | 400 hours | 200 hours | 7 |
| 4 | 800 hours | 400 hours | 8 |
| 8 | 1600 hours | 800 hours | 9 |
| 16 | 3200 hours | 1600 hours | 10 |

Conversely, the sample can be compared with the blue scale after a certain exposure time and assessed correspondingly.

In the following examples, parts denote parts by weight and percentages percent by weight. The temperatures are given in degrees Celsius; the dyes are employed in commercially available form.

EXAMPLE 1

A degreased and deoxidized sheet of pure aluminium is anodically oxidized for 40–50 minutes at a voltage of from 15 to 16 volts with direct current with a density of 1.5 A/dm$^2$ in an aqueous solution containing 18–22 parts of sulphuric acid and 1.2–7.5 parts of aluminium sulphate in 100 parts, at a temperature of from 18 to 20° C. An oxide layer with a thickness of about 20–24 $\mu$m is formed. After rinsing with water, the anodized aluminium sheet is dyed for 40 minutes at 60° C. in a solution consisting of 0.5 part of the dye of the formula (1)

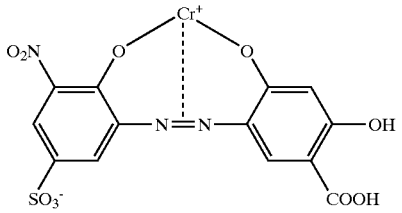

as the sodium salt, in 1000 parts of deionized water, whose pH has been adjusted to 5.5 with acetic acid and sodium acetate. The dyed sheet is rinsed with water and then divided into two halves.

The first half is sealed in deionized water at from 98 to 100° C. for 40–50 minutes. The light fastness on the blue scale, determined in accordance with ISO specification No. 105 B02 (USA) (after dry exposure with a standard illuminant in an Atlas Ci 35 A Weather-O-meter), is 3 (after 100 hours).

The other half is sealed in a 2 g/l $NiF_2$ solution in deionized water at from 28 to 30° C. for 20 minutes and subsequently post-sealed in boiling deionized water for 30 minutes. The light fastness on the blue scale, determined in accordance with ISO specification No. 105 B02 (USA) (after dry exposure with a standard illuminant in an Atlas Ci 35 A Weather-O-meter), is 7 (first brake after 200 hours).

EXAMPLE 2

The procedure is as in Example 1, with the difference that instead of the dye of the formula (1), 1 part of the dye of the formula (2)

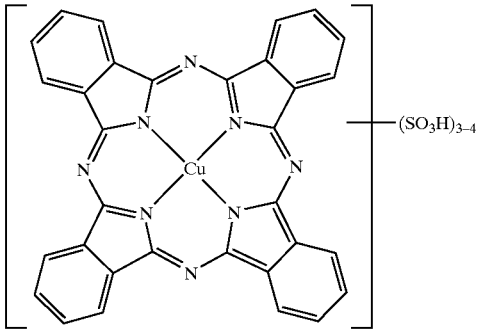

as the sodium salt, is used. The dyed sheet is rinsed with water and then divided into two halves.

The first half is sealed in deionized water at from 98 to 100° C. for 40–50 minutes. The light fastness on the blue scale, determined in accordance with ISO specification No. 105 B02 (USA) (after dry exposure with a standard illuminant in an Atlas Ci 35 A Weather-O-meter), is 5–6 (after 100 hours).

The other half is sealed in a 2 g/l $NiF_2$ solution in deionized water at from 28 to 30° C. for 20 minutes and subsequently post-sealed in boiling deionized water for 30 minutes. The light fastness on the blue scale, determined in accordance with ISO specification No. 105 B02 (USA) (after dry exposure with a standard illuminant in an Atlas Ci 35 A Weather-O-meter), is 7 (first brake after 200 hours).

EXAMPLE 3

The procedure is as in Example 1, with the difference that instead of the dye of the formula (1), 0.3 part of the dye of the formula (3)

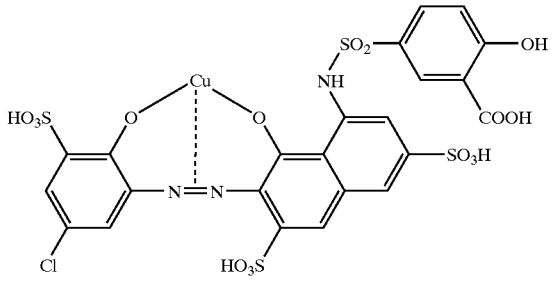

as the solution salt, is employed. The dyed sheet is rinsed with water and then divided into two halves.

The first half is sealed in deionized water at from 98 to 100° C. for 40–50 minutes. The light fastness on the blue scale, determined in accordance with ISO specification No. 105 B02 (USA) (after dry exposure with a standard illuminant in an Atlas Ci 35 A Weather-O-meter), is 4–5 (after 100 hours).

The other half is sealed in a 2 g/l $NiF_2$ solution in deionized water at from 28 to 30° C. for 20 minutes and subsequently post-sealed in boiling deionized water for 30 minutes. The light fastness on the blue scale, determined in accordance with ISO specification No. 105 B02 (USA) (after dry exposure with a standard illuminant in an Atlas Ci 35 A Weather-O-meter), is 9 (first brake after 800 hours).

What is claimed is:

1. Process for the production of dyed oxide layers on aluminium or aluminium alloys by dyeing in an aqueous dyebath, rinsing with water and sealing, where the dyeing is carried out using at least one water-soluble anionic dye (A) which possesses at least one substituent and/or component combination with a ligand character that is capable of forming a nickel complex with nickel ions, and the sealing is carried out by cold sealing with at least one sealing agent (B) containing nickel ions $Ni^{2+}$ and fluoride ions $F^-$.

2. Process according to claim 1, where, for the sealing, a two-step sealing is carried out, in which, in the first step, cold sealing is carried out with at least one sealing agent (B), and in the second step, hot secondary sealing is carried out with water.

3. Process according to claim 1, where the dyes (A) are dyes with which dyeings are produced on the oxide layers whose light fastness, determined in accordance with ISO specification No. 105 B02 (USA), after hot-sealing with water or with a nickel compound, corresponds to a light fastness grade of below 7.

4. Process according to claim 1, where the dyes (A) are sulfo group-containing dyes which contain at least one substituent and/or component combination with a ligand character capable of forming a labile nickel complex with nickel ions.

5. Process according to claim 1, where the dyes (A) are sulfo group-containing dyes which contain at least one salicylic acid group, optionally in salt form, or are copper complexes which contain nitrogen atoms as ring members of a heterocyclic ring, only some or none of which participate in the copper complex formation.

6. Process according to claim 1, where (B) is employed in the form of (B)-containing sealing agent preparation ($B_P$).

7. The oxide layers dyed by the process according to claim 1.

8. Dyed oxide layers according to claim 7 with a light fastness corresponding to a light fastness grade, in accordance with ISO specification No. 105 B02 (USA), which is at least two grades higher than an otherwise identical dyeing which, however, has been hot-sealed with water.

9. Dyed oxide layers according to claim 8 with a light fastness corresponding to a light fastness grade, in accordance with ISO specification No. 105 B02 (USA), of ≧8.

10. Dyed oxide layers according to claim 8 with a light fastness corresponding to a light fastness grade, in accordance with ISO specification No. 105 B02 (USA), of ≧7.

11. Process according to claim 3, where the dyes (A) are the dyes of the general formulae:

(I)

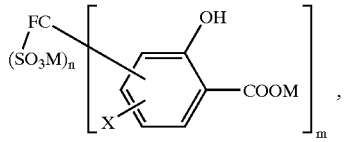

in which X denotes hydrogen or a bond to FC, m denotes 1 or 2, n denotes a number from 1 to twice the total number of aromatic rings in the molecule, M denotes hydrogen or a non-chromophoric cation and FC denotes the (m+n)-valent residual chromophoric part of the dye, (II)

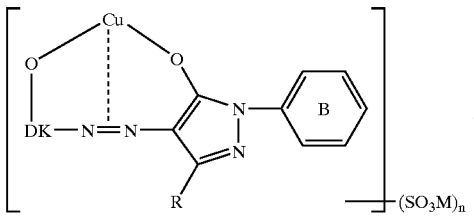

in which R denotes $C_{1-4}$-alkyl,

M denotes hydrogen or a non-chromophoric cation, n denotes a number from 1 to twice the total number of aromatic rings in the molecule, and DK denotes the radical of a diazo component, and the ring B may optionally be further substituted, for example with $C_{1-4}$-alkyl, and (III)

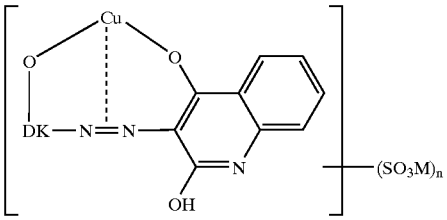

, in which M denote hydrogen or a non-chromophoric cation, n denotes a number from 1 to twice the total number of aromatic rings in the molecule and DK denotes the radical of a diazo component.

12. Process according to claim 4, where the dyes (A) are the dyes of the general formulae:

(I)

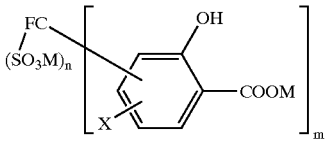

, in which X denotes hydrogen or a bond to FC, m denotes 1 or 2, n denotes a number from 1 to twice the total number of aromatic rings in the molecule, M denotes hydrogen or a non-chromophoric cation and FC denotes the (m+n)-valent residual chromophoric part of the dye, (II)

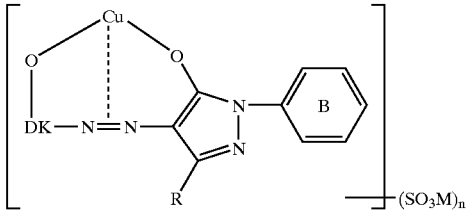

, in which R denotes $C_{1-4}$-alkyl,

M denotes hydrogen or a non-chromophoric cation, n denotes a number from 1 to twice the total number of aromatic rings in the molecule, and DK denotes the radical of a diazo component, and the ring B may optionally be further substituted, for example with $C_{1-4}$-alkyl, and (III)

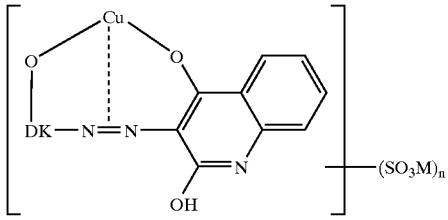

, in which M denotes hydrogen or a non-chromophoric cation, n denotes a number from 1 to twice the total number of aromatic rings in the molecule and DK denotes the radical of a diazo component.

13. Process according to claim 5 wherein the sulpho group containing copper complexes are copper phthalocyanine complexes or 1:1 copper complexes of monoazo dyes which contain a coupling component from the oxyquinoline or pyrazolone series.

* * * * *